United States Patent [19]

Brown et al.

[11] 3,965,689

[45] June 29, 1976

[54] VENTING OF CRYOGENIC STORAGE TANKS

[75] Inventors: Lester E. Brown; Harry H. West, both of Norman, Okla.

[73] Assignee: University Engineers, Inc., Norman, Okla.

[22] Filed: July 18, 1974

[21] Appl. No.: 489,936

[52] U.S. Cl. ..... 62/50; 62/268; 220/14; 220/88 B

[51] Int. Cl.[2] ..... F17C 7/02

[58] Field of Search ..... 62/48, 50, 51, 54, 268, 62/269, 270; 220/88 B, 85 VR, 85 VS, 9 LG, 14

[56] References Cited

UNITED STATES PATENTS

| | | | |
|---|---|---|---|
| 2,283,502 | 5/1942 | Hughes et al. | 220/88 B |
| 2,406,540 | 8/1946 | Harrington | 220/85 VS |
| 2,507,380 | 5/1950 | Morrison | 62/1 |
| 2,760,342 | 8/1956 | Morrison | 62/48 |
| 2,989,969 | 6/1961 | Gascoin | 220/88 B |
| 3,109,294 | 11/1963 | Messer | 220/14 X |
| 3,121,999 | 2/1964 | Kasbohm et al. | 62/48 |
| 3,279,198 | 10/1966 | Ayers et al. | 62/45 |
| 3,636,853 | 1/1972 | Sable | 98/78 |
| 3,783,911 | 1/1974 | Husa et al. | 141/11 |

*Primary Examiner*—William F. O'Dea
*Assistant Examiner*—Ronald C. Capossela
*Attorney, Agent, or Firm*—Laney, Dougherty, Hessin & Fish

[57] ABSTRACT

A method and apparatus for venting cryogenic storage tanks. In the method, a non-flammable, non-combustion supporting, relatively warm gas is mixed with cold vapors vented from a cryogenic storage tank to warm the vented vapors to a characteristic density less than that of the air adjacent the tank. The apparatus employed includes a vent pipe having a Venturi ejection throat therein, a pressure relief valve spaced from the ejection throat, and a gas ejector nozzle extending into the vent pipe between the safety relief valve and the ejection throat.

14 Claims, 1 Drawing Figure

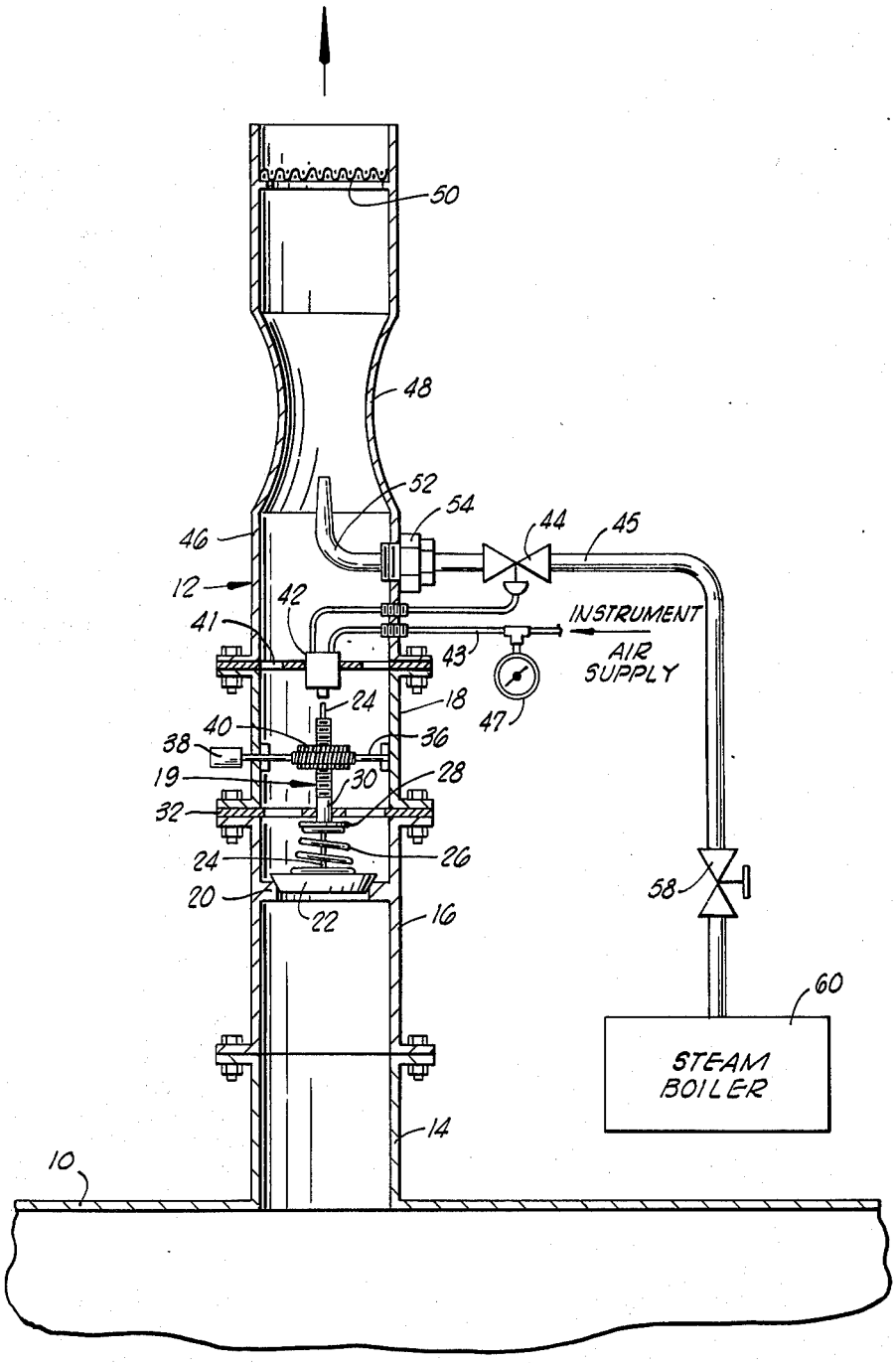
50
48
52
54
44
45
46
12
42
41
INSTRUMENT
AIR
SUPPLY
43
47
24
18
40
36
38
19
30
28
32
24
26
20
22
16
58
60
STEAM
BOILER
14
10

VENTING OF CRYOGENIC STORAGE TANKS

BACKGROUND OF THE INVENTION

1. Field of the Invention

This invention relates to the atmospheric venting of vapors from cryogens, and more particularly, to the venting of cold, relatively dense natural gas emanating from a confined body of liquefied natural gas.

2. Brief Description of the Prior Art

The hazard of venting heavy gases or vapors from storage facilities or other locations containing stored liquids or vapors is frequently encountered in industry. A particular situation often experienced is the venting from storage tanks of explosive fumes or vapors derived from volatile liquids contained within the storage tank, with such venting occurring at such times as a sufficient pressure builds within the storage tank to actuate a safety relief valve or other device of similar character. Hydrocarbon vapors which are flammable in admixture with air are frequently sufficiently dense that they accumulate along or over the ground adjacent storage tanks, or other points of venting, and constitute a safety hazard.

It has been proposed in U.S. Pat. No. 2,866,475 to Sutherlin et al. to dilute volatile, flammable vapors by admixing atmospheric air with such vapors as they are vented from a stack or other discharge conduit disposed at the top of a storage tank for volatile liquids. A venting system is provided in which the flow of the flammable hydrocarbon vapors through a nozzle in the stack serves to induce atmospheric air to flow through a Venturi inlet passageway and become admixed with the hydrocarbon vapors. This results in a dilution of the vapors as they are discharged from the stack into the surrounding atmosphere, so that the concentration of vapors in air is reduced to below ignition concentrations and the danger of explosion is reduced or obviated. This method of dilution of some types of flammable hydrocarbon vapors with air is undesirable, however, because in reaching a low level of concentration where flammability and explosion are no longer likely, the mixture must pass through an explosive range of concentration of the vapors in air, thereby constituting at least a temporary explosion hazard. The hazard arising from the transition of the mixture through the explosive range is enhanced by the fact that often, rapid venting through a relatively small stack conduit occurs, and static charges building up on the top of the tank or such conduit can easily ignite the explosive mixture thus formed.

One specific instance where venting of flammable vapors has previously constituted a safety hazard is that involving the venting of cold natural gas from storage tanks containing liquefied natural gas, hereinafter referred to as LNG. Such storage tanks are normally provided with pressure relief valves which open to allow escape of vapors when the tank contents become unstable due to rollover, stratification or other causes. The pressure relief valves employed will open under a pressure differential of from about 1 psi to about 2 psi between the interior of the tank and the ambient environment. This sensitivity will allow opening of such valves even upon significant changes in barometric pressure.

In LNG storage tanks, the natural gas in equilibrium with the LNG is cold and is more dense than air. This gas, when vented, will therefore move downwardly to ground level, or at least will be slow to dissipate by upward movement into the atmosphere. An attempt to dilute the natural gas vapors to below ignition concentrations with air in the manner described in U.S. Pat. No. 2,866,475 is hazardous because in accomplishing dilution to this level, the mixture must pass through the explosive range (5 – 15 percent of the natural gas in air). The danger is amplified by the real possibility of sparking originating with the build-up of static charges on the tank and vent stack. An explosion at or within the pressure relief valve can shear this structure from the tank, thereby exposing the entire tank contents to possible ignition. Other stored cryogenic materials can pose similar problems attributable to the density of the cold vapors, and their flammability, or in some instances, toxicity.

A similarly hazardous release of natural gas vapors has occurred in natural gas liquefaction plants when the plant is brought off-stream. At this time the content of the "cold box" is vented through the stack, and fires frequently occur at this location. Such fires have been controlled by nitrogen snuffers which dilute the vapors below the flammability limit by the use of large amounts of nitrogen gas.

BRIEF DESCRIPTION OF THE PRESENT INVENTION

The present invention relates to a method and apparatus for safely venting dangerous vapors from a storage tank or other facility in which a liquid or gaseous material is confined. Broadly described, the method of the invention comprises mixing with the vented vapors, a relatively warm gas capable of warming the vented vapors sufficiently to substantially reduce the density thereof. The warm gas is introduced to the stream of vented gas at a relatively high velocity in an upward direction, so that the combination of the effects of warming and upward movement disperse the vapors at a safely high altitude. The warming gas employed is preferably inert with respect to the vented gas in the sense of not forming an explosive or flammable mixture therewith, and not combining therewith to form a toxic compound or mixture. It is further preferred that the warming gas or vapor used be capable of dissipating static electricity charges from the tank and venting structure.

In one of the most useful and preferred applications of the principles of the invention, steam is ejected into cold natural gas vented from an LNG storage facility.

The apparatus of the invention comprises a vent pipe having a Venturi ejection throat therein and a safety pressure relief valve spaced in the pipe from the ejection throat. An ejector jet or nozzle is positioned adjacent the ejection throat. A source of warming gas is connected to the ejector nozzle. In a preferred structural arrangement, the vent pipe is provided with a mist screen through which a mixture of the vented gas and steam, used as the warming gas, can be advantageously discharged. An automatic control linkage is also beneficially provided for admitting the warming gas to the ejector nozzle at a time when the pressure relief valve opens, and for terminating the flow of warming gas when the relief valve closes.

An important object of the present invention is to provide a totally safe method for venting cold flammable or toxic vapors from a facility containing such vapors, or a liquid constituting a source thereof.

A further and more specific object of the invention is to provide a method for venting cold natural gas from a liquefied natural gas storage facility so that the natural gas vapors do not accumulate in the vicinity of the storage facility or descend to ground level.

Another object of the invention is to provide an apparatus for venting flammable or toxic vapors from a storage facility, or any container from which such vapors are periodically vented, which apparatus is relatively simple and economical in construction, of relatively light weight and can be operated efficiently by operators of relatively little training or skill, or, in the alternative, can be made to operate automatically.

An additional object of the invention is to provide a system for warming cold vapors vented from a storage facility to the extent that such vapors will ascend in the air, and concurrently with such warming of the vented vapors, accomplishing the discharge of any accumulated static charges which may be present on the surface of the storage facility or the venting structure.

Additional objects and advantages of the invention will become apparent as the following detailed description of preferred embodiments of the invention is considered in conjunction with the accompanying drawing which illustrates certain apparatus constituting a preferred embodiment of the invention.

BRIEF DESCRIPTION OF THE DRAWINGS

The single drawing FIGURE presented herewith illustrates apparatus utilized in one embodiment of the invention for the purpose of venting a relatively cold gas from a storage facility or other confining structure.

DETAILED DESCRIPTION OF PREFERRED EMBODIMENTS OF THE INVENTION

In carrying out the method of the invention, a gas or vapor which is at ambient temperature or higher is admixed with a gas being vented from a storage facility, or other source, to a location in relatively close proximity to the ground. The method of the invention is especially applicable to vented gases derived from stored cryogenic material so that the vented gas is relatively cold and therefore generally characterized by a density such that it does not rise in the surrounding air. The gas or vapor which is added to the vented gas will be hereinafter referred to as a warming gas, since its primary function is to warm the vapor or gas being vented sufficiently that it will ascend relative to the point of venting. The amount of the warming gas which is added to the vented gas is generally the minimum amount required to elevate the temperature of the vented gas sufficiently to render it "lighter" than the ambient air around the vent pipe or other source of venting, and thereby enable it to move upwardly in the atmosphere. The warming gas is admixed with the vented gas by ejecting the warming gas from a nozzle into the vented gas in an upward direction so as to impart a sufficient upward velocity to the gas to aid its ascendency.

The degree to which the cold vented gas must be warmed in order to reduce its density sufficiently to permit it to rise in the surrounding air will generally be easily susceptible of determination. For example, in one of the most useful applications of the invention, an inert, relatively warm gas is admixed with a vented stream of natural gas originating from an LNG storage facility. Such natural gas, upon venting, is quite cold and must be warmed to a temperature of at least about −150°F in order to reduce its density sufficiently that it will rise freely in the surrounding air. Other cryogenic materials will, of course, pose different warming requirements, but in each case, the warming gas used must be sufficiently warm, and dispersed in the vented gas to an adequate degree, that as the mixture is discharged from the vent pipe or other emitting structure, it is sufficiently buoyant in relation to the ambient air that it will rise rapidly in the air, rather than "hang" about the stack or vent pipe, or descend to ground level.

A preferred warming gas for use in the present invention is steam. This material is of advantage because it can be relatively economically provided, is inert and does not support combustion, and provides the marked benefit of allowing static charges to continually be bled off, or discharged safely, from the vent pipe or other structure through which the vented gas is passing, and from the top of the tank or vessel upon which it is located. The capability of the steam for discharging static electricity from the described physical structures is, of course, due to the polar character of the water molecules. Other inert gaseous materials having polar molecular structures can, of course, be used with similar advantage. In the case of dilution of LNG with steam, a weight ratio of about 1:5, steam to LNG, provides a very suitable degree of dilution.

Another useful warming gas which can be employed in the invention is, for example, nitrogen. Although the use of nitrogen does not facilitate the bleed-off of static charges which is characteristic of steam usage, the nitrogen, like steam, is relatively inexpensive in comparison to many other gases, can be safely warmed or heated prior to admixture with the vented gas, and forms no combustible or flammable mixtures with vented gases of substantially any type.

Practice of the method of the invention can be carried out to avoid undesirable low level accumulations of vent gases, whether avoidance of such accumulations is a desideratum due to flammability, toxicity or simply because of large accumulations presenting possibilities of asphyxiation in confined spaces. In general, the method is most useful where the vented gas is less dense than the surrounding air at ambient temperatures.

A structure which can be usefully employed in carrying out the method of the invention is depicted in the drawing. The wall 10 of a storage or other confining structure has mounted thereon, an upwardly extending vent pipe assembly designated generally by reference numeral 12. The vent pipe assembly 12 includes a flanged tubular base section 14 having two flanged tubular intermediate sections 16 and 18 secured in axial alignment above the base section by flanged connections.

The vent pipe assembly 12 has positioned therein a safety pressure relief valve assembly, designated generally by reference numeral 19. The relief valve assembly 19 includes a suitable annular valve seat 20 extending around the interior of the intermediate section 16 and accommodating a pressure relief valve head 22 which cooperates with the seat 20 to obstruct passage of vented gas through the vent pipe assembly 12. The pressure relief valve head 22 is carried on the lower end of an elongated shaft 24 mounted axially in the vent pipe assembly 12 for reciprocating movement therein. A compression spring 26 surrounds the shaft 24 and has one of its ends abutting the valve head 22 and its opposite end abutting a spring stop plate 28. The spring stop plate 28 is secured to the lower end of an upwardly projecting control sleeve 30. The control sleeve 30 has a bore extending therethrough which slidingly and reciprocably receives the upper end portion of the shaft 24. The upper portion of the control sleeve 30 is externally threaded, and the lower portion thereof is smooth to facilitate free vertical movement through the central web portion of a perforated spider plate 32 mounted between the flanges of tubular sections 16 and 18.

For the purpose of adjusting the differential pressure at which the pressure relief valve will open, a control rod 36 is extended transversely across the interior of the intermediate tubular section 18 along a chord of this section, and is rotatably supported in suitable bearings secured to the interior of this tubular section. One end of the control rod 36 projects to the outside of the tubular section 18 and carries a control knob 38. Suitable gearing 40 is provided in cooperation with the control rod 36 and the threaded upper portion of the control sleeve 30 to facilitate driving the control sleeve 30 in vertical reciprocation when the control rod is rotated.

A second perforated spider plate 41 is mounted between the flanges of the intermediate tubular section 18 and a Venturi section 46 which is connected to the upper end of tubular section 18. A mechanically activated normally closed pneumatic relay 42 is mounted through the central web portion of the plate 41 with the activator portion thereof positioned above the upper end of the shaft 24 in alignment therewith. The relay 42 is serially connected in control piping 43 which leads instrument air supply to a conventional pneumatically operated control valve 44 disposed in warming gas conduit 45. As will be further described hereinafter, when the pressure relief valve assembly 19 opens thereby causing the shaft 24 to move upwardly into contact with the activator portion of the relay 42, the relay 42 opens allowing instrument air to pass therethrough to the operator of control valve 44 opening control valve 44. An instrument air supply pressure indicator 47 is disposed in the piping 43 upstream of the relay 42 for providing a continuous indication of the presence of instrument air thereto. As is well understood by those skilled in the art, a variety of conventional pneumatic, hydraulic or mechanically operated controllers and control valves can be substituted for the relay 42 and control valve 44. Further, if desired, the relay 42 can be of a type and arranged with respect to the shaft 24 so that the opening of control valve 44 is controlled in accordance with the extent of opening of the relief valve assembly 19, i.e., the flow rate of warming gas allowed to pass through valve 44 increased or decreased with increases or decreases in the flow rate of cold gas being vented.

The Venturi section 46 is provided with a reduced diameter Venturi ejection throat 48 intermediate its ends and, in a preferred embodiment of the invention, carries a mist screen 50 adjacent the upper end of this section.

For the purpose of introducing a jet or rapidly moving stream of warming gas into the cold vented gas, an ejector jet or nozzle 52 is secured in the Venturi section 46 immediately upstream from the Venturi ejection throat 48. The ejector nozzle 52 is positioned on the axis of the vent pipe assembly 12, and is connected to a suitable fitting 54 in the wall of the Venturi section 46 so that the pipe or conduit 45 carrying warming gas can be communicated therewith through this fitting. The warming gas conduit 45 preferably carries, in addition to the valve 44, a main control valve 58 positioned between the fitting 54 and a source of warming gas which, in a preferred embodiment of the invention, is a steam boiler 60 illustrated schematically in the drawing. It is important, at this juncture, to note, while referring to the warming gas system (which includes the conduit 45, the valves 44 and 58 and the warming gas source), that the described structure facilitates the location of the warming gas source, which can be a boiler in the case of steam, at a remote location, and does not require the imposition of the heavy load, constituted by gas generating equipment, on the top wall of the storage vessel.

In the use of the apparatus of the invention, the pressure relief valve assembly 19 is pre-set by means of the control knob 38 to open at a selected differential pressure acting across the valve. Thus, in the event of the occurrence of a pressure build-up within the storage vessel or other confining structure, the pressure relief valve will open by movement of the valve head 22 off of the seat 20, thereby opening the vent pipe assembly 12 to passage of vented gas through the length thereof. With the opening of the pressure relief valve, the relay 42 is opened by the upward movement of the shaft 24. The resultant flow of instrument air and pressure associated therewith through the relay 42 into and on the operator of the valve 44 in the conduit 45 opens the valve 44.

As the valve 44 in the conduit 45 opens, and assuming the main control valve 58 is at this time open, steam from the steam boiler 60 is allowed to pass through the conduit 45 to the ejector nozzle 52. At this point, the steam is discharged from the nozzle 52 with a substantial velocity so that the admixture of steam and vented gas attains an upward velocity and momentum sufficient to carry the vented gas upwardly away from the upper end of the vent pipe assembly 12. The amount of steam introduced is, of course, sufficient to warm the vent gas and thereby decrease its density so that it will become buoyant with respect to the ambient air immediately surrounding the vent pipe assembly.

At such time as a sufficient amount of gas from within the storage facility or other point of origin has been vented in order to reduce the pressure differential across the safety pressure relief valve assembly 19 to a level below that at which this valve assembly is set to close, the valve head 22 will then be forced by the spring 26 to return to the seat 20 and further venting of gas will be terminated. The downward movement of the valve head 22 also results in a downward reciprocation of the shaft 24 so that the relay 42 is again closed causing the valve 44 to close terminating the flow of steam through the conduit 45.

Although certain preferred embodiments of the method and apparatus of the present invention have been herein described in order to illustrate the basic principles underlying the invention, it will be appreciated that various changes and innovations can be effected in the illustrated and described structural embodiment of the invention, and that other types of warming gases than those specifically identified can be employed in carrying out the steps of the invention in accordance with the basic principles made clear by the illustrative disclosure herein appearing. Changes and innovations of these types are therefore intended to be comprehended and included within the spirit and scope of the invention, except as the same may be necessarily limited by the appended claims or reasonable equivalents thereof.

What is claimed is:

1. Apparatus for discharging cold, relatively dense gases to the atmosphere at a location near ground level comprising:

a vent pipe;

a Venturi ejection throat in said vent pipe;

a safety pressure relief valve spaced in the vent pipe from the Venturi ejection throat;

nozzle means in the vent pipe positioned to discharge a warming gas into a vented gas passing through the vent pipe along a path traversing the pressure relief valve and the Venturi ejection throat; and means connected to said nozzle means and exterior of the vent pipe for supplying a warming gas to said nozzle means.

2. Apparatus for discharging cold, relatively dense gases to the atmosphere as defined in claim 1 wherein said nozzle means is positioned between said ejection throat and said pressure relief valve and opens in a direction to discharge warming gas through the ejection throat.

3. Apparatus for discharging cold, relatively dense gases to the atmosphere as defined in claim 1 and further characterized as including a mist screen carried by said vent pipe in a position to intercept fluids traversing the vent pipe.

4. Apparatus for discharging cold, relatively dense gases to the atmosphere as defined in claim 1 wherein said means connected to said nozzle comprises a conduit, and wherein said apparatus further comprises automatic control means connected to said relief valve for automatically admitting warming gas into said nozzle means from said conduit when said safety pressure relief valve opens, and for automatically interrupting flow of warming gas to said nozzle when said relief valve closes.

5. Apparatus for discharging cold, relatively dense gases to the atmosphere as defined in claim 1 wherein said warming gas supplying means comprises:

a source of steam; and conduit means connecting the source of steam to said nozzle means.

6. Apparatus for safely storing liquefied natural gas comprising:

a storage tank for containing the liquefied natural gas;

a vent pipe secured to the storage tank at a level above the liquefied natural gas therein and extending in a generally vertical direction from its point of securement to the storage tank;

a Venturi ejection throat in said vent pipe;

a safety pressure relief valve in the vent pipe between the ejection throat and the point of attachment of the vent pipe to the tank;

a nozzle positioned in the vent pipe between the relief valve and the ejection throat and opening in a direction to discharge steam through the ejection throat;

a steam boiler spaced from the storage tank; and conduit means connected between said steam boiler and nozzle for conveying steam to the nozzle.

7. In a method for venting heavier-than-air cold vapors from a cryogenic liquid storage facility in which is stored, at cryogenic temperature, a liquid material which evolves vapors capable of forming combustible or explosive mixtures with air, and which vapors, at the time of venting, are above their explosive concentration in air, the improvement which comprises admixing with the denser-than-air cold vapors at a point of venting in the upper side of the storage facility, a warmer, non-flammable gas which is non-reactive with the vapors, said gas having a temperature sufficiently higher than the temperature at which said cold vapors are vented to warm the vapors sufficiently that they will become less dense than air and ascend to a safe level in the atmosphere.

8. The method improvement as defined in claim 7 wherein said cryogenic liquid stored at a cryogenic temperature is liquefied natural gas.

9. The method improvement defined in claim 8 wherein said non-flammable gas is admixed with cold natural gas from the liquefied natural gas by venting the cold natural gas in an upward direction, and jetting the non-flammable gas thereinto in an upward direction to impart upward momentum to the mixture moving it upwardly with respect to the liquefied natural gas storage facility.

10. The method improvement defined in claim 7 wherein said non-flammable gas is steam, and the minimum amount of steam is mixed with said cold vapors which is needed to warm the vapors to a temperature such that they are less dense than air and will ascend to a safe level in the atmosphere.

11. The method improvement defined in claim 10 wherein said cryogenic liquid stored at a cryogenic temperature is liquefied natural gas.

12. The method defined in claim 11 wherein the steam is admixed with cold natural gas vapors from the liquefied natural gas in a weight ratio not exceeding 1:5, steam to natural gas.

13. The method improvement defined in claim 11 wherein the amount of steam admixed with cold natural gas vapors from the liquefied natural gas is the minimum amount needed to warm the vented natural gas to a temperature of at least −150°F.

14. In a method for venting cold natural gas vapors from a liquefied natural gas storage tank as a result of a pressure differential not exceeding about 2 psi between the interior of the tank and the ambient environment, the improvement which comprises admixing with the denser-than-air cold natural gas vapors at the point of venting at the upper side of the storage tank, a heated non-flammable gas which is non-reactive with natural gas, which non-flammable gas is admixed with the natural gas in an amount such that the amount of natural gas in the mixture exceeds 15 volume per cent and the amount of added non-flammable gas in the mixture is the least amount required to elevate the temperature of the vented cold natural gas sufficiently to render it lighter than the ambient air immediately adjacent the point of venting, thereby enabling the natural gas to move upwardly in the atmosphere.

* * * * *